US007001538B2

(12) United States Patent
Lee et al.

(10) Patent No.: US 7,001,538 B2
(45) **Date of Patent: *Feb. 21, 2006**

(54) PTC COMPOSITION AND PTC DEVICE COMPRISING THE SAME

(75) Inventors: Yong-In Lee, Seoul (KR); Hyun-Nam Cho, Seoul (KR); Jong-Hawk Kim, Seoul (KR)

(73) Assignee: Shinwha Intertek Corporation, Kyonggi-do (KR)

( * ) Notice: Subject to any disclaimer, the term of this patent is extended or adjusted under 35 U.S.C. 154(b) by 125 days.

This patent is subject to a terminal disclaimer.

(21) Appl. No.: 10/472,927

(22) PCT Filed: Feb. 27, 2002

(86) PCT No.: PCT/KR02/00328

§ 371 (c)(1),
(2), (4) Date: Sep. 26, 2003

(87) PCT Pub. No.: WO02/080200

PCT Pub. Date: Oct. 10, 2002

(65) Prior Publication Data

US 2004/0099846 A1 May 27, 2004

(30) Foreign Application Priority Data

Mar. 29, 2001 (KR) ..... 2001-16587

(51) Int. Cl.
*H01B 1/22* (2006.01)

(52) U.S. Cl. ..... 252/511; 252/512; 252/514; 338/22 R

(58) Field of Classification Search ..... 252/511, 252/512, 514; 338/22 R
See application file for complete search history.

(56) References Cited

U.S. PATENT DOCUMENTS 3,351,881 A 11/1967 Merz (Continued)

FOREIGN PATENT DOCUMENTS

JP 5-109502 4/1993

OTHER PUBLICATIONS

KR 1999-184320 B1 (Dai-Ichi Kogyo Seiya Ku Co., Ltd.) Dec. 18, 1998.

(Continued)

*Primary Examiner*—Mark Kopec
(74) *Attorney, Agent, or Firm*—Dickstein, Shapiro, Morin & Oshinsky, LLP.

(57) ABSTRACT

The present invention relates to a conductive polymer composition having PTC properties, that is, a PTC composition, and a PTC device comprised thereof, in particular, it relates to a PTC composition and a PTC device comprising thereof, wherein the PTC composition comprises: a) at least one crystalline thermoplastic olefin-based polymer and at least one rubber-based polymer resin containing unsaturated group; and b) conductive particles dispersed in a polymer matrix formed of component a). The PTC device comprising the PTC composition makes it possible to construct circuit protecting devices which can stably maintain their initial resistance value in spite of repeated current cycling by short-circuit.

12 Claims, 5 Drawing Sheets

U.S. PATENT DOCUMENTS 4,237,441 A 12/1980 van Konynenburg et al.
4,330,704 A * 5/1982 Jensen ..... 219/553
4,520,260 A * 5/1985 Kotian et al. ..... 219/553
4,545,926 A 10/1985 Fouts, Jr. et al.
5,880,668 A 3/1999 Hall
6,051,655 A * 4/2000 Nakano et al. ..... 525/240
6,828,362 B1 * 12/2004 Lee et al. ..... 524/47

OTHER PUBLICATIONS

KR 2001-43781 A (Nisshin Bo Industries, Inc.) May 25, 2001.
JP 08-120182 A (Nok Corp) May 14, 1996.

* cited by examiner

PTC COMPOSITION AND PTC DEVICE COMPRISING THE SAME

TECHNICAL FIELD

The present invention relates to a conductive polymer composition having PTC (positive temperature coefficient) properties (that is, PTC composition) and to a PTC device using the same.

BACKGROUND ART

A conductive material exhibiting a resistance change according to a temperature change and a device using the same have been well known. A conventional PTC resistor has been known as a PTC thermistor using a doped $BaTiO_3$ ceramic material. A thermistor made of the ceramic material exhibits a sharp PTC resistance effect at a higher temperature than its Curie temperature. Although the PTC device made of the ceramic material has long been used, it has a problem that it is restricted in applications and causes a high process expense because it has a relatively high resistance value at room temperature.

In an effort to solve the above problem, a conductive polymer composition that can be more easily fabricated compared to the conventional ceramic process, as well as which has a small resistance value at room temperature, has been developed. As examples, U.S. Pat. Nos. 4,237,441, 4,545,926 and 5,880,668 are given.

The conductive polymer compositions disclosed in the above documents exhibit. "PTC property" in which it has an electrical conductivity by uniformly dispersing carbon black or metal powder as a conductive filler into a polymer matrix, whereby its resistance is increased in proportion to a temperature rise, and its resistance is rapidly increased when the temperature goes up to higher than a certain point called a switching temperature.

The polymers used for the conventional PTC composition are mostly olefin-based polymers, for example, polyethylene (PE), polypropylene (PP), ethylene/propylene co-polymers and ethylene-based co-polymers such as ethylene(meta) acrylic acid co-polymers, ethylene ethyl acrylate co-polymers, ethylene butyl acrylate co-polymers and ethylene vinyl acetate co-polymers. Besides, polyvinyl-based co-polymers such as polyvinylchloride, polyvinylidenechloride, polyvinylfluoride, polyvinylidenfluoride, thermoplastic polymers such as polyamide, polystyrene, polyacrylonitrile, silicone resins, polyester, a modified cellulose or polysulfone may be used.

The PTC composition is typically used as a circuit protection device for limiting a current flow when a short-circuiting has taken place in the circuit comprising a heater, a positive character thermistor, a thermo-responsive sensor, a battery or the like, and for recovering the circuit to a normal state when the cause of the short-circuiting is removed. In addition, as an example of using the PTC composition, a PTC device, in which more than two electrodes are electrically connected to the PTC composition, can be given. The electrodes are connected to a power supply so that the current can flow through the PTC device. The PTC device is used as a protecting device for a circuit from current overload, overheating and the like, by functioning as a self-temperature controller as described above.

The device generally allows current to flow through a circuit since the resistance is low enough at a temperature below the switching temperature (Ts). However, at a temperature above the switching temperature, it does not allow any further current to flow, by rapidly increasing the resistance. In other words, when the circuit is heated up to a critical temperature, the PTC device functions as a circuit protecting device for decreasing a current overload caused by a short-circuiting to a lower and stable value. When the cause of the fault state is removed, the PTC device is cooled down below the critical temperature and returned to the low resistance state of its normal operation. Such effect is called a "reset". The composition of which the PTC device is constructed is necessary to have such a current limiting performance and reset property allowing a repeated use at high voltage.

A polymer PTC electric circuit protecting device is generally formed by inserting a PTC component, which is fabricated by dispersing electrically conductive fine particles such as metal powder or carbon black into polymers, between a pair of electrodes. The electrodes are connected to a power supply so that the current can flow through the PTC device. In order to minimize a contact resistance, the electrodes are generally attached to the PTC composition by a thermo-fusion. However, in such methods, adhesion between components in the composition has been a problem. In order to overcome the problem, in the past, the surface of the electrodes was chemically or physically treated to be rough, or specially fabricated electrodes have been used (Japanese Laid Open Publication No. 5-109502 and U.S. Pat. No. 3,351,882, etc.). However, those methods have disadvantages in that the problem of contact resistance is not satisfactorily solved, and it is difficult to expect the repetition stability returning to the same resistance value as that of the initial stage even after several times of short-circuiting have taken place.

In addition, when a high working current is required even though its size is limited such as in a lithium ion battery, the PTC device to be inserted into the circuit is also limited in size. In general, in case of a PTC device, the maximum current value (that is, a hold current, $I_{Hmax}$), which is maintained at a normal working state without switching, differs according to the power consumption. The power consumption is related to an initial resistance of the device. The lower the initial resistance is, relatively the less the power consumption is, and accordingly, the PTC device can have a high maximum hold current. Thus, in the PTC device, as it has a high maximum hold current, in order to lower the resistance value of the device, the distance between a pair of electrodes is made short or the surface area of the electrodes has to be enlarged. If the space between the two electrodes becomes narrow, the resistance value of the device is also lowered down as much. However, if the space between the electrodes is too narrow, a PTC component constructed therebetween may easily be cracked by even a weak external impact, and it is not easy to manufacture, too. Therefore, in general, the area of the electrodes is enlarged while maintaining a certain thickness. In this respect, if the resistance value of the PTC component inserted between the electrodes is not low enough, the size of the formed device should be inevitably enlarged to larger than the limited circuit size to have a high hold current. In addition, if the contact resistance is high due to an insufficient adhesion, power consumption may be concentrated in the interface of the electrodes and the PTC component, and accordingly it is impossible to obtain the high maximum hold current.

In other words, the resistance value of the PTC component itself and the contact resistance between the electrodes and the PTC component should be low enough so as to retain a high hold current while allowing the PTC device to be inserted into a limited size of circuit to have a sufficiently small size. Also, in the case of the conventional PTC device using the conventional conductive polymer material, there has been a problem of reduced voltage characteristic when the resistance makes low in order to minimize the voltage drop. In order to solve such problems, a method of connecting two or more devices in parallel has been suggested. However, this method causes another problem in which a resistance increase at high temperature is also reduced when the resistance of the conductive polymer composition at room temperature is set to be low, and accordingly, the PTC intensity is reduced.

Therefore, it is still necessary to provide a PTC device having a sufficient PTC properties in which the resistance can be rapidly increased at high temperature while the resistance can be maintained low enough at room temperature.

SUMMARY OF THE INVENTION

Therefore, an object of the present invention is to solve problems of conventional device and to provide a PTC composition which exhibits a low resistance and a favorable electrical conductivity when a normal current flows in a circuit, is capable of minimizing a contact resistance by improving an adhesion in the interface of electrodes and the PTC composition without any special treatment to the electrodes and maximizing a PTC effect and hold current, and has a thermal and voltage stability.

Another object of the present invention is to provide a circuit protecting device that is capable of maintaining an initial resistance value repeatedly and stably even in passing a current due to several times of short-circuiting.

The above and other objects described in the detailed description of the invention are achieved by providing a PTC composition comprising, a) at least one crystalline thermoplastic olefin-based polymer and at least one rubber-based polymer resin containing unsaturated group; and b) conductive particles dispersed in a polymer matrix formed of component a).

DETAILED DESCRIPTION OF THE INVENTION

Figure 1:
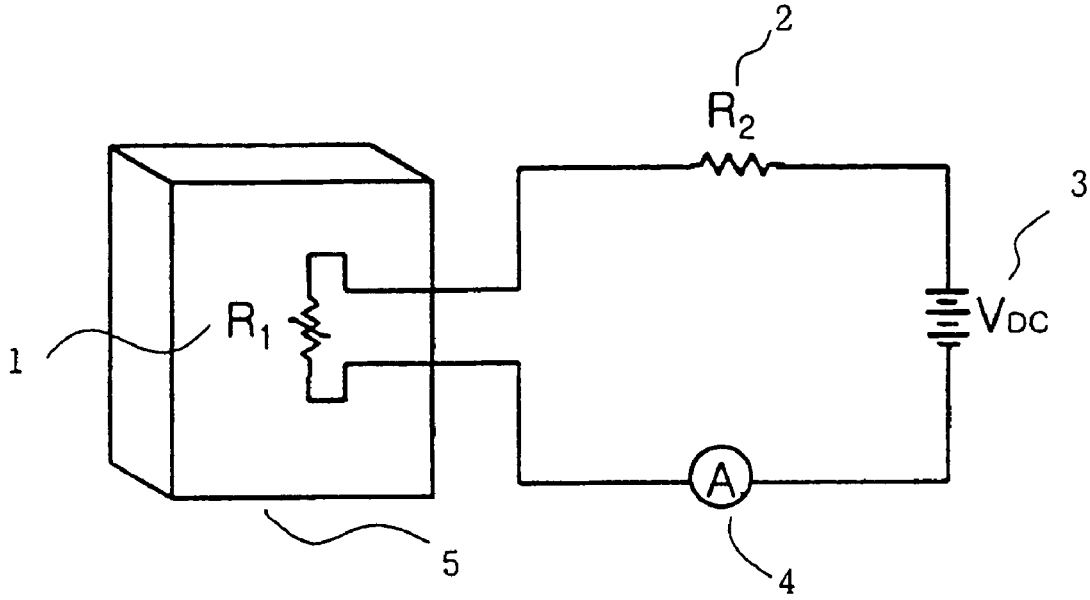
FIG. 1 shows a circuit and a device constructed to measure a maximum hold current ($I_{Hmax}$).

The present invention relates to a PTC composition which exhibits a low resistance and a favorable electrical conductivity when a normal current flows in a circuit, is capable of minimizing a contact resistance by improving an adhesion in the interface of electrodes and the PTC composition without any special treatment to the electrodes and maximizing a PTC effect and hold current, and has a thermal and voltage stability, and to a PTC device using the same. In more particularly, the present invention relates to a PTC composition comprising a) at least one crystalline thermoplastic olefin-based polymer and at least one rubber-based polymer resin containing unsaturated group; and b) conductive particles dispersed in a polymer matrix formed of component a), and to a PTC device using the same.

The crystallinity of the thermoplastic olefin-based polymer used for the PTC composition of the present invention is to be at least 10%, and preferably, at least 20%, and, more preferably, at least 40%. The content of the thermoplastic olefin-based polymer is adjusted to be at least 60% by weight and, more preferably, in the range of 80–99.9% by weight of the entire polymer in the PTC composition.

The olefin-based polymer is preferably selected from the group consisting of polyethylene (PE), polypropylene (PP), a co-polymer of ethylene and a monomer having a polar group, a co-polymer of propylene and a monomer having a polar group and mixtures thereof.

Examples of the polyethylene include a high-density polyethylene (HDPE), a middle-density polyethylene (MDPE) and a low-density polyethylene (LDPE), a linear low-density polyethylene (LLDPE) and mixtures thereof, of which the high-density polyethylene is more preferable.

Examples of the co-polymer of ethylene or propylene with a monomer having a polar group include ethylene acrylic acid co-polymers, ethylene methacrylic acid co-polymers, ethylene ethyl acrylate co-polymers, ethylene butyl acrylate co-polymers, ethylene vinyl acetate co-polymers, ethylene itaconic acid co-polymers, ethylene monomethyl malate co-polymers, ethylene maleic acid co-polymers, ethylene/acrylic acid/methyl methacrylate co-polymers, ethylene methacrylic acid ethyl acrylate co-polymers, ethylene monomethyl malate ethyl acrylate co-polymers, ethylene/methacrylic acid/vinyl acetate co-polymers, ethylene/acrylic acid/vinyl alcohol co-polymers, ethylene propylene acrylic acid co-polymers, ethylene styrene acrylic acid co-polymers, ethylene methacrylic acid/acrylonitrile co-polymers, ethylene fumarinic acid vinyl methyl ether co-polymers, ethylene vinyl chloride/acrylic acid co-polymers, ethylene/vinylidene chloride/acrylic acid co-polymers, ethylene/trifluoroethylene chloride/methacrylic acid co-polymers, ethylene styrene sulfonic acid sodium salt copolymer, ethylene acrylic acid zinc salt copolymer and propylene co-polymers corresponding to respective ethylene copolymers.

Maleic anhydride-grafted polyethylene, and more specifically, maleic anhydride-grafted high-density polyethylene (m-HDPE), maleic anhydride-grafted low-density polyethylene (m-LDPE), and substituted polyolefin resins such as a chlorinated polyethylene (CM), chlorosulfonated polyethylene (CSM), etc. can also be used for the PTC composition of the present invention.

Each of the above mentioned thermoplastic olefin-based polymer resins can be used independently, or together with at least one other resins.

As the rubber-based polymer resin containing unsaturated group which is used with the thermoplastic olefin-based polymer, natural rubber (NR), isoprene rubber (IR), butadiene rubber (BR), styrene-butadiene rubber (SBR), butyl rubber (IIR), chloroprene rubber (CR), nitrile-based rubber (NBR), carboxylated nitrile-based rubber (XNBR), ethylene-propylene-diene rubber (EPDM), sulfonated EPDM, butadiene (metha)acrylic acid-based rubber resin, polynorbonene (Norsorex™), polypentenamer, polyoxtenamer, styrene-based linear and branched copolymer Kraton rubber (Kraton™), styrene-butadiene-based rubber (SB), styrene-isoprene-based rubber (SI), styrene-butadiene-styrene-based rubber (SBS), styrene-isoprene-styrene-based rubber (SIS), and styrene-ethylene-butylene-styrene-based rubber (SEBS), etc. can be exemplified. The above-mentioned resin can be used independently or together with each other. The above-mentioned resin can be also used together with a rubber resin selected from the group consisting of a silicon rubber, fluoride rubber, acrylic rubber, epichlorohydrin rubber and mixtures thereof. The amount of the rubber resin containing unsaturated group to be used is not particularly limited. However, it is preferred that 0.1–40% by weight, more preferably 0.5–20% by weight of the entire polymer in the composition is added.

Where the polymer PTC composition is prepared using the rubber-based polymer resin containing unsaturated group together with the crystalline thermoplastic olefin-based polymer resin, since a predetermined amount of unsaturated group is present in the composition, a cross-linking can be carried out more smoothly in cross-linking by heat, chemical and/or radiation. Also, it is possible to sufficiently achieve the object of the present invention in aspects of cross-linking, stability of voltage and device, and PTC effect.

The PTC composition of the present invention may further comprise a polyvinyl polymer such as polyvinylchloride, polyvinylidenechloride, polyvinylfluoride and polyvinylidenefluoride, and a thermoplastic polymer such as polyamide, polystyrene, polyacrylonitrile, silicon resin, polyester resin-grafted cellulose and polysulfone. If the above material is added, its content is in the range of 0.5–50% by weight of entire polymer.

The conductive particles dispersed in the polymer matrix are used for granting conductivity to the PTC composition of the present invention. The conductive particles used are not particularly limited as long as they are typical conductive particles generally used for a PTC composition. Examples may include powder of metal such as nickel, silver, gold, copper or metal alloys, particles coated with a metal, carbon black and acetylene black.

The most preferred conductive particle among the above particles is carbon black. The carbon black particles used in the present invention preferably have a uniform mean particle size distribution, and it is preferred that their mean particle size is at least 60 nm. As detailed examples of the carbon black which may be used in the present invention, there are Conductex 975, Raven 420, Raven 430 and N660 available from Columbian Chemical Co. and Black Pearl 120, Black Pearl 130, Black Pearl 160 and Vulcan XC72 available from Cabot Co., but not limited thereto.

The amount of conductive particles used may be differentiated according to materials used. It is preferred that its amount is typically in the range of 5–70% by weight of entire composition.

The conductive particles exhibit different mechanisms in cross-linking and dispersion according to functional groups contained in the polymer resin used. For example, If an unsaturated group and/or a polar group are present in the polymer resin, the cross-linking reaction can take place smoothly in chemical and/or radiation cross-linking, or an interaction between the conductive particles and the resin is strengthened. As a result, voltage and device stability, PTC effect and adhesion on the interface between an electrode and the resin are improved, and thereby the contact resistance can be minimized without a special treatment on the electrode. Accordingly, a cross-link and an electronic passageway can be easily formed in the PTC composition. Therefore, the PTC composition of the present invention has stable and low resistance value and can increase a hold current comparing to the conventional PTC composition, even though the same conductive particles as in the conventional PTC composition are used. Moreover, the interaction between the conductive particles and polymer can maintain stable cross-linking degree and constant strength regardless of temperature rising and going down. Therefore, even if the PTC device is located where low and high temperature is continuously repeated, an initial dispersion of the composition can be maintained. Therefore, the PTC effect can be maximized, and a restoration stability, by which the resistance is restored to its initial value when the normal working state is restored after the resistance is much increased when the temperature goes up due to a current overload in the device, can be considerably increased.

The PTC composition of the present invention may further comprise a co-processing agent not influencing on the properties of the composition, such as an antioxidant, an anti-degradation agent, an anti-foaming agent, a cross-linking agent, a crosslinking aid-agent, a dispersant, a binder, a plasticizer, a stabilizer, a surfactant and the like.

The PTC device of the present invention can be constructed in the following method. Conductive particles, preferably a carbon black, and an antioxidant, etc are added to a mixture of a crystalline thermoplastic olefin-based polymer resin and a rubber-based polymer resin containing unsaturated group, and the resulting mixture is blended with Bravendar, Banbari, homo-mixer or the like to obtain the PTC composition of the present invention. After at least one metallic electrode is then shaped to the obtained conductive polymer composition, in order to improve stability and reliability of the device, the obtained polymer PTC composition is cross-linked by a chemical method, more preferably, by using an electron beam. At this time, according to the components, contents of the components and thickness of the composition, the electron beam is irradiated at an intensity of 1–100 Mrads, preferably, 5–50 Mrads. The shape of the electrode is determined depending on the shape of the device. For example, there is a foil, wire, powder, paste or the like of a metal. In the present invention, two thin metallic films are attached onto both surfaces of the conductive polymer composition, to be shaped as the plate-shape polymer composition is inserted between two electrodes. Lead electrodes are shaped onto the two plate-shape electrodes so as to be connected to an electric circuit. A wire or plate of a metal is soldered at the lead electrode. The material of the electrode may be a metal such as iron, copper, tin, nickel, silver or the like.

The circuit protecting device in which electrodes are shaped as described above usually has a resistance of below 5Ω, preferably below 1Ω, and more preferably below 0.1Ω, at room temperature (25° C.). When the temperature rises, at a higher temperature than a critical temperature where the device is switched, the maximum resistance value becomes at least $10^3\Omega$, and preferably at least $10^4\Omega$.

The PTC composition according to the present invention is capable of maximizing the PTC effect and the hold current, superior in temperature and voltage stability, and capable of minimizing the contact resistance by improving the interfacial adhesion with electrode without a special treatment on the electrode. Therefore, a PTC device constructed with the PTC composition of the present invention can be useful to fabricate a circuit protecting device for maintaining an initial resistance value stably even in flowing a current due to several times of short-circuiting.

EXAMPLES

Hereinafter, the present invention will now be described in more detail with reference to the following examples, but the scope of the present invention is not limited thereto.

Example 1

42.4 parts of high density polyethylene (HDPE 8380, Hanwha Chemical Co.), 5.3 parts of Surlyn 8940 (Dupont), 3.3 parts of Kraton FG-1901X (Shell Chem. Co.), 2.0 parts of Kraton D-1101 (Shell Chem. Co.), 47.0 parts of carbon black (N660, Columbian Chem. Co.) and 0.2 parts of antioxidant (Irganox 1010, Ciba-Geigy Co.) were mixed at a speed of 60 rpm at 190° C. for 20 minutes using a Bravendar mixer (Plasti-corder, PLE 331). The mixed composition was put into a mold, pressed to make a thin plate of 0.5 mm in thickness under a pressure of 450 Kgf/cm$^2$ at 200° C., set aside under a pressure of 110 Kgf/cm$^2$ at 80° C. for an hour, and then allowed to return to room temperature and an atmospheric pressure. Ni plated electro-deposited copper foil in a thickness of 30 $\mu$m having a micro-level of roughness on the surface of one side was melted and pressed to both sides of the plate of the conductive polymer composition obtained above, to shape plate-shape electrode. The plate of the conductive polymer composition stacked with the plate-shape electrodes was irradiated at an intensity of 20 Mrads using a particle beam accelerator to cross-link the polymer composition, and then shaped in a disk type having a diameter of 12.7 mm using a punch. The device and tin-coated copper wire were put into a solvent which is used for removing oxide from a melted metal and preventing additional oxidation of the melted metal, and then put into a melted solder bath. The PTC device and tin-coated copper wire were then taken out from the solder bath and cooled down, and then the tin-coated copper wire was attached to the surface of the plate-shape electrodes stacked onto the PTC device.

Figure 3:
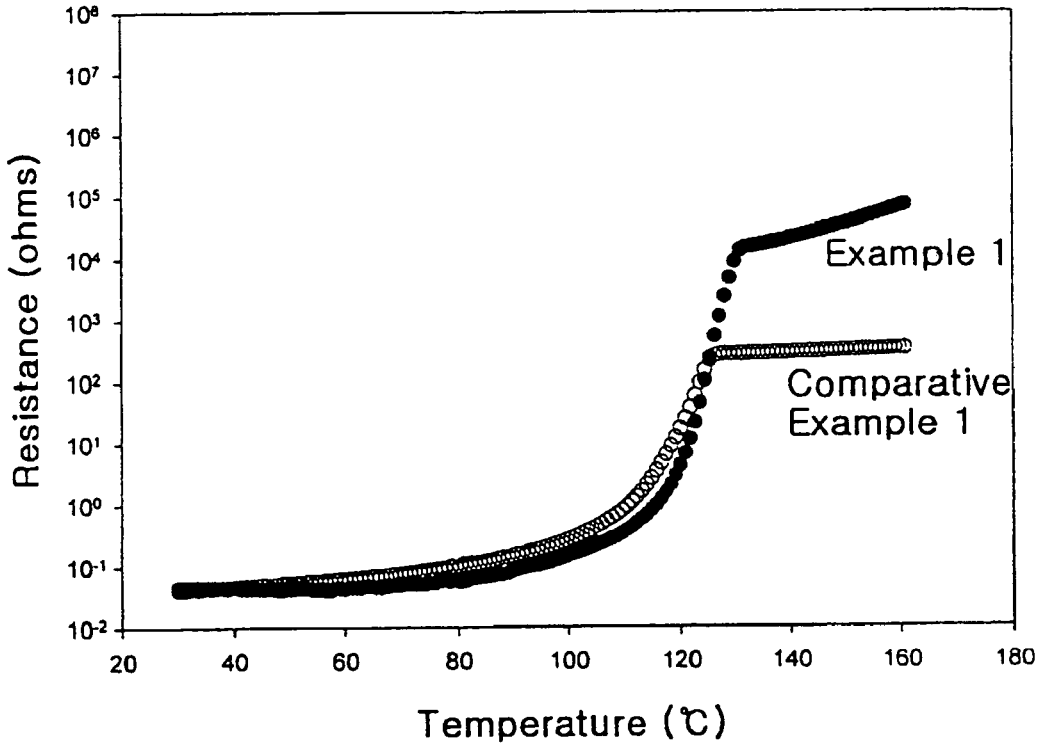
FIG. 3 is a graph showing temperature dependencies of resistance values, that is, PTC effects of devices prepared in Example 1 and Comparative Example 1.

The electrical and PTC properties of the electric circuit protecting device fabricated as described above were measured by the procedures followed by Table 1, and results are shown in Table 1 and FIG. 3.

TABLE 1

| | *Resistance at room temperature (mΩ) | **Resistance at high temperature (kΩ) | PTC intensity ($R_{max}/R_{min}$) | Maximum Voltage ($V_{max}$) | Maximum hold current (mA) |
|---|---|---|---|---|---|
| Example 1 | 44 | 12.90 | $2.9 \times 10^5$ | 80 | 2800 |
| Comparative Example 1 | 45 | 0.27 | $6.0 \times 10^3$ | 25 | 2750 |
| Example 2 | 48 | 406.26 | $8.4 \times 10^6$ | 140 | 2520 |
| Comparative Example 2 | 48 | 2.75 | $5.7 \times 10^4$ | 40 | 2510 |
| Example 3 | 55 | 171.78 | $3.1 \times 10^6$ | 108 | 2410 |
| Comparative Example 3 | 67 | 2.45 | $3.7 \times 10^4$ | 38 | 2320 |
| Example 4 | 47 | 13.20 | $2.8 \times 10^5$ | 60 | 2420 |
| Example 5 | 45 | 43.30 | $9.6 \times 10^5$ | 82 | 2450 |
| Example 6 | 42 | 5.46 | $1.3 \times 10^5$ | 53 | 2330 |
| Example 7 | 45 | 333.00 | $7.4 \times 10^6$ | 132 | 2630 |
| Example 8 | 61 | 51.24 | $8.4 \times 10^5$ | 97 | 2350 |
| Example 9 | 52 | 27.51 | $5.3 \times 10^5$ | 63 | 2400 |
| Example 10 | 49 | 32.83 | $6.7 \times 10^5$ | 75 | 2530 |
| Example 11 | 46 | 15.64 | $3.4 \times 10^5$ | 62 | 2610 |
| Example 12 | 41 | 69.70 | $1.7 \times 10^6$ | 83 | 2710 |
| Example 13 | 64 | 224.10 | $3.5 \times 10^6$ | 120 | 2320 |
| Example 14 | 42 | 36.92 | $8.8 \times 10^5$ | 73 | 2690 |
| Example 15 | 45 | 34.00 | $6.8 \times 10^5$ | 70 | 2470 |

*resistance value at 25° C.
**resistance value at switching temperature +20° C.

(1) The device was set aside at a temperature above the melting point of the polymer composition used for fabricating the device for 10 minutes, cooled down to the room temperature, and then the resistance was measured. While the temperature around the device was gradually raised at a rate of 2° C./min, the resistance change according to the temperature change was measured with a digital multimeter (Keithley 2000). The ratio between the initial and maximum resistance values was calculated by using the resistance value change measured and indicated as "PTC intensity".

(2) The PTC device was inserted into a circuit constructed as shown in FIG. 1 for measuring the maximum hold current, a stabilized current inside the device was measured while gradually increasing an applied DC voltage by taking 0.05 V as one step. The applied voltage was continuously increased until the device was completely switched. While increasing the applied voltage, the current value passed through the PTC device was measured, and the maximum current value was defined as a "maximum hold current ($I_{Hmax}$). When the voltage is increased over this point, the current falls down.

Figure 2:
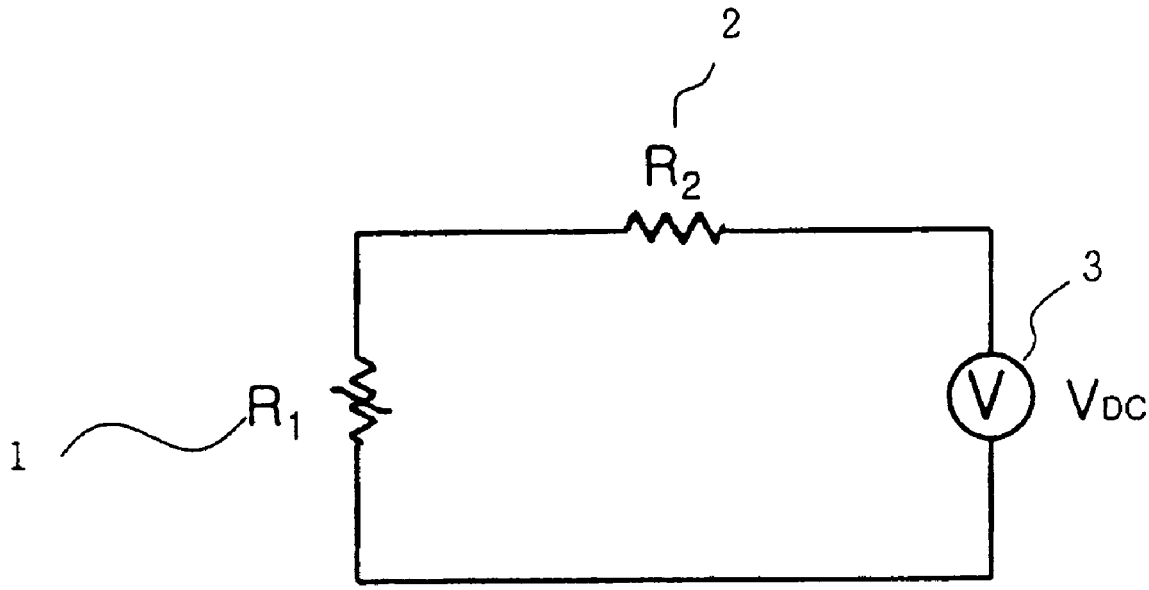
FIG. 2 shows a circuit constructed to measure a maximum voltage ($V_{max}$).

(3) As shown in FIG. 2, the device was inserted into the circuit comprising a power supply device and a resistance device for restricting the current flow. When DC voltage was applied for 30 minutes to the circuit, the voltage, by which the device was not sparked or burned, and the composition and the electrode were not separated, was defined as a "maximum voltage ($V_{max}$)".

Major reference numerals in FIGS. 1 and 2 are as follows:

1: PTC device resistance
2: load resistance
3: DC power supply
4: current-meter
5: Constant Temperature Unit Box The conductive polymer compositions were prepared with varying the polymer components, and physical properties of the PTC device comprising the same were measured. The compositions of the polymer composition according to the respective Examples and Comparative Examples are shown in the following Table 2.

TABLE 2

| | Crystalline olefin-based polymer | | Unsaturated rubber-based polymer | | Optional Component | |
|---|---|---|---|---|---|---|
| | Component | Content (part) | Component | Content (part) | Component | Content (part) |
| Example 1 | HDPE | 42.4 | Kraton FG-1901X<br>Kraton D-1101 | 3.3<br>2.0 | Surlyn 8940 | 5.3 |
| Comparative Example 1 | HDPE | 47.7 | — | | Surlyn 8940 | 5.3 |
| Example 2 | EM 510H | 47.7 | Kraton FG-1901X<br>Kraton D-1101 | 3.3<br>2.0 | — | |
| Comparative Example 2 | EM 510H | 53 | — | | — | |
| Example 3 | HDPE 8380 | 42.4 | KEP570P | 5.3 | Ethylene-acrylic acid copolymer (Premacor) | 5.3 |
| Comparative Example 3 | HDPE | 47.7 | — | | Premacor 1410 | 5.3 |
| Example 4 | EM 530 | 42.4 | Kraton D-1107 | 5.3 | Surlyn 7930 | 5.3 |
| Example 5 | EM 530 | 42.4 | Kraton G-1650 | 3.3 | Surlyn 8940 | 5.3 |
| Example 6 | LDPE 5312P | 42.4 | Kraton D-1101 | 5.3 | Surlyn 8940 | 5.3 |
| Example 7 | EM 510H | 42.4 | KrynacX7-50 | 5.3 | Surlyn 7930 | 5.3 |
| Example 8 | HDPE 8380 | 42.4 | OZO-HA | 5.3 | Ethylene-ethylacrylate copolymer (EEA A-702) | 5.3 |
| Example 9 | EM 530 | 42.4 | DENKATA-105 | 5.3 | Ethylene-vinylacetate copolymer (EVA 360) | 5.3 |
| Example 10 | EM 530 | 42.4 | Kraton D-1184 | 5.3 | Chlorosulfonated polyethylene (CSM-220) | 5.3 |
| Example 11 | EM 530 | 42.4 | Kraton D-1184X | 5.3 | Surlyn 8940<br>polyethylene chloride (daisolac P304) | 2.3<br>3.0 |
| Example 12 | EM 530 | 42.4 | KratonG-1701X<br>Kraton PG-1901X<br>KratonD-1184X | 2.3<br>2.0<br>1.0 | Surlyn 8940 | 5.3 |
| Example 13 | EM 530 | 42.4 | KratonG-1701X<br>Krynac X7-50 | 3.3<br>2.0 | EEA A-714 | 5.3 |
| Example 14 | EM 530 | 42.4 | Polynorbonene | 5.3 | Premacor 1410 | 5.3 |
| Example 15 | EM 530 | 42.4 | Kraton FG-1901X<br>OZO-HA | 3.3<br>2.0 | EEA A-710<br>Surlyn 7930 | 3.3<br>2.0 |

Comparative Example 1

Instead of 42.4 parts of HDPE 8380, 5.3 parts of Surlyn 8940, 3.3 parts of Kraton FG-1901X and 2.0 parts of Kraton D-1101 of Example 1, 47.7 parts of HDPE 8380 and 5.3 parts of Surlyn 8940 were used for preparing a PTC composition and device in the same manner as in Example 1. Physical properties were measured, and the results are shown in Table 1 and FIG. 3.

Example 2

Figure 4:
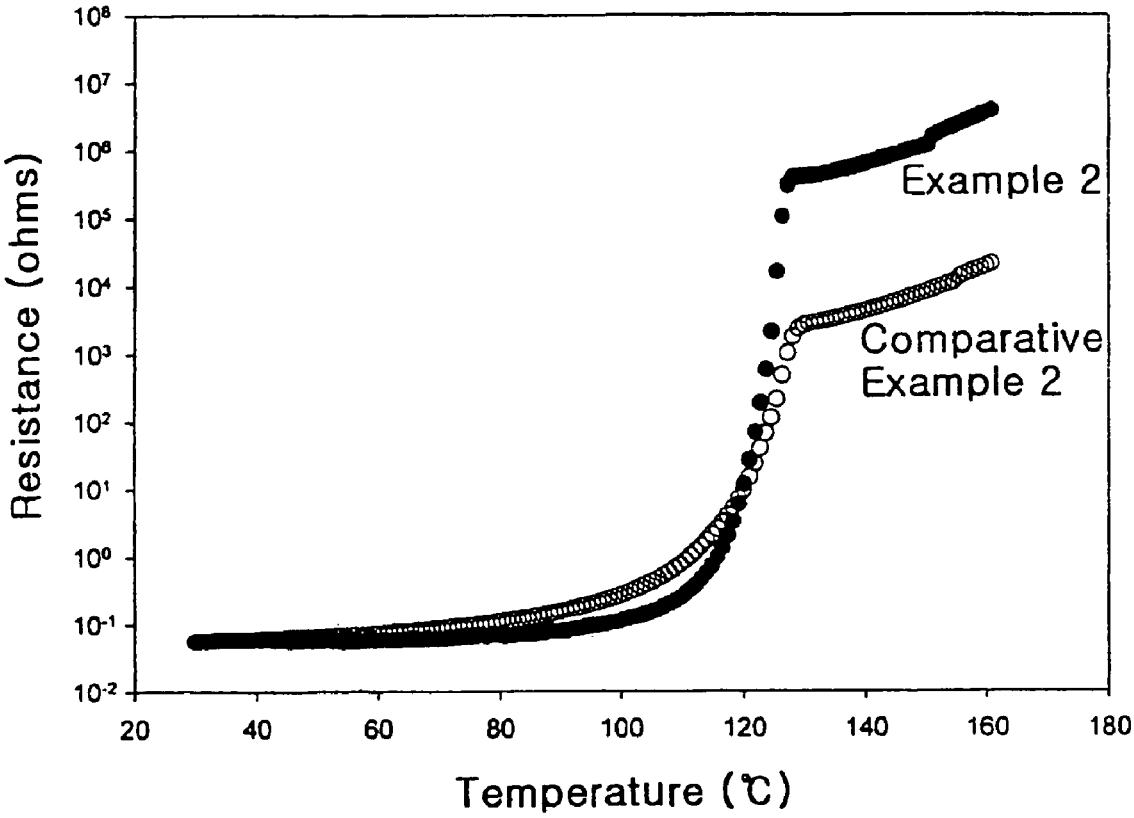
FIG. 4 is a graph showing PTC effects of devices prepared in Example 2 and Comparative Example 2.

Instead of 42.4 parts of HDPE 8380, 5.3 parts of Surlyn 8940, 3.3 parts of Kraton FG-1901X and 2.0 parts of Kraton D-1101 of Example 1, 47.7 parts of maleic anhydride-grafted high-density polyethylene (EM 510H, Honam Chem. Co.), 3.3 parts of Kraton FG-1901X and 2.0 parts of Kraton D-1101 were used for preparing a PTC composition and device in the same manner as in Example 1. Physical properties were measured, and the results are shown in Table 1 and FIG. 4.

Comparative Example 2

Instead of 47.7 parts of EM 510H, 3.3 parts of Kraton FG-1901X and 2.0 parts of Kraton D-1101 of Example 2, 53 parts of EM 510H was only used for preparing a PTC composition and device in the same manner as in Example 1. Physical properties were measured, and the results are shown in Table 1 and FIG. 4.

Example 3

Figure 5:
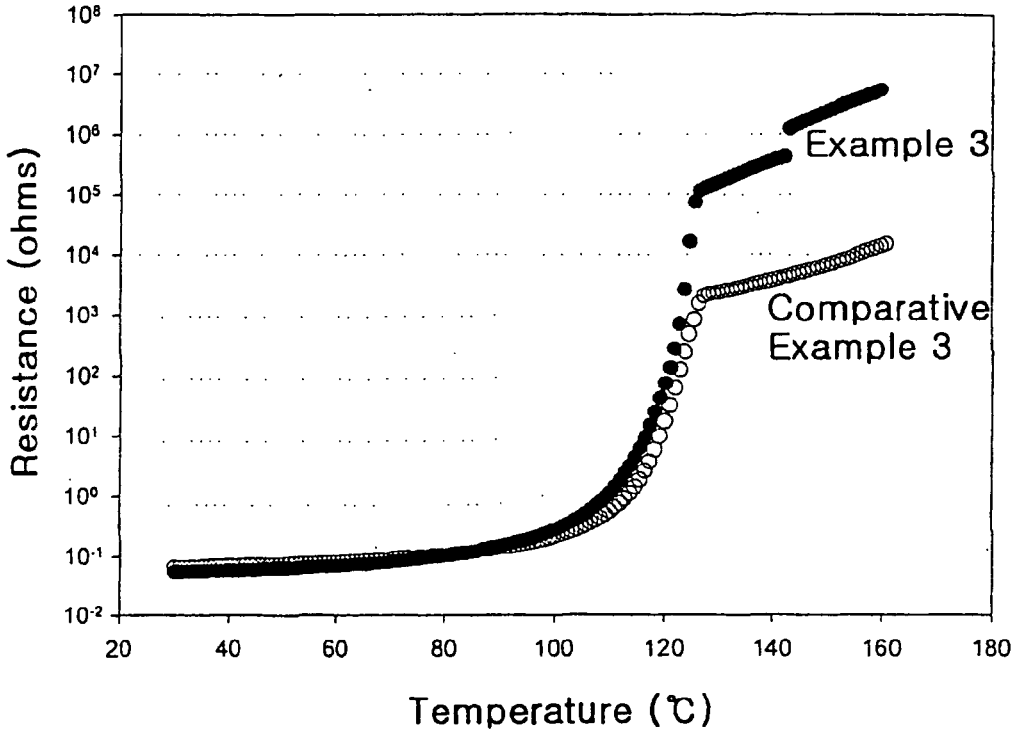
FIG. 5 is a graph showing PTC effects of devices prepared in Example 3 and Comparative Example 3.

Instead of 42.4 parts of HDPE 8380, 5.3 parts of Surlyn 8940, 3.3 parts of Kraton FG-1901X and 2.0 parts of Kraton D-1101 of Example 1, 42.4 parts of HDPE 8380, 5.3 parts of ethylene-acrylic acid copolymer (Premacor 1410, Dow Chem. Co.) and 5.3 parts of EPDM (KEP570P, Kumho Chem. Co.) were used for preparing a PTC composition and device in the same manner as in Example 1. Physical properties were measured, and the results are shown in Table 1 and FIG. 5.

Comparative Example 3

Instead of 42.4 parts of HDPE 8380, 5.3 parts of Premacor 1410 and 5.3 parts of KEP 570P of Example 3, 47.7 parts of HDPE 8380 and 5.3 parts of Premacor 1410 were used for preparing a PTC composition and device in the same manner as in Example 1. Physical properties were measured, and the results are shown in Table 1 and FIG. 5.

Example 4

Instead of 42.4 parts of HDPE 8380, 5.3 parts of Surlyn 8940, 3.3 parts of Kraton FG-1901X and 2.0 parts of Kraton D-1101 of Example 1, 42.4 parts of maleic anhydride-grafted linear low density polyethylene (EM 530, Honam Chem. Co.), 5.3 parts of Surlyn 7930 and 5.3 parts of Kraton D-1107 were used for preparing a PTC composition and device in the same manner as in Example 1. Physical properties were measured, and the results are shown in Table 1.

Example 5

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 5.3 parts of Surlyn 8940, 3.3 parts of Kraton G-1650 and 2.0 parts of Kraton D-1184 were used for preparing a PTC composition and device in the same manner as in Example 1. Physical properties were measured, and the results are shown in Table 1.

Example 6

Instead of 42.4 parts of HDPE 8380, 5.3 parts of Surlyn 8940, 3.3 parts of Kraton FG-1901X and 2.0 parts of Kraton D-1101 of Example 1, 42.4 parts of low density polyethylene (LDPE 5312P, Hanwha Chem. Co.), 5.3 parts of Surlyn 8940 and 5.3 parts of Kraton D-1101 were used for preparing a PTC composition and device in the same manner as in Example 1. Physical properties were measured, and the results are shown in Table 1.

Example 7

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 510H, 5.3 parts of Surlyn 7930 and 5.3 parts of carboxylated nitrile-based rubber (KrynacX 7-50, Bayer Polysar) were used for preparing a PTC composition and device in the same manner as in Example 1. Physical properties were measured, and the results are shown in Table 1.

Example 8

Instead of 42.4 parts of HDPE 8380, 5.3 parts of Surlyn 8940, 3.3 parts of Kraton FG-1901X and 2.0 parts of Kraton D-1101 of Example 1, 42.4 parts of HDPE 8380, 5.3 parts of ethylene-ethylacrylate copolymer (EEA A-702, Dupont-Mitsui Polychem.) and 5.3 parts of nitrile rubber (OZO-HA, Uniroyal Chem.) were used for preparing a PTC composition and device in the same manner as in Example 1. Physical properties were measured, and the results are shown in Table 1.

Example 9

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 5.3 parts of ethylene-vinyl acetate copolymer (EVA 360, Dupont-Mitsui Polychem.) and 5.3 parts of chloroprene rubber (DENKA TA-105, Denki Kagaku Kogyo) were used for preparing a PTC composition and device in the same manner as in Example 1. Physical properties were measured, and the results are shown in Table 1.

Example 10

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 5.3 parts of chlorosulfonated polyethylene (CSM-220, Denki Kagagu Kogyo) and 5.3 parts of Kraton D-1184 were used for preparing a PTC composition and device in the same manner as in Example 1. Physical properties were measured, and the results are shown in Table 1.

Example 11

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 2.3 parts of Surlyn 8940, 3.0 parts of chlorinated polyethylene (Daisolac P304, Osaka Soda Co.) and 5.3 parts of D-1118X were used for preparing a PTC composition and device in the same manner as in Example 1. Physical properties were measured, and the results are shown in Table 1.

Example 12

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 5.3 parts of Surlyn 8940, 2.3 parts of Kraton G-1701X, 2.0 parts of Kraton FG-1 901 X and 1.0 part of Kraton D-1184X were used for preparing a PTC composition and device in the same manner as in Example 1. Physical properties were measured, and the results are shown in Table 1.

Example 13

Instead of 42.4 parts of HDPE 8380, 5.3 parts of Surlyn 8940, 3.3 parts of Kraton FG-1901X and 2.0 parts of Kraton D-1 101 of Example 1, 42.4 parts of EM 530, 5.3 parts of EEA A-714, 3.3 parts of Kraton G-1701X and 2.0 parts of Krynac X7-50 were used for preparing a PTC composition and device in the same manner as in Example 1. Physical properties were measured, and the results are shown in Table 1.

Example 14

Instead of 42.4 parts of HDPE 8380, 5.3 parts of Surlyn 8940, 3.3 parts of Kraton FG-1901X and 2.0 parts of Kraton D-1101 of Example 1, 42.4 parts of EM 530, 5.3 parts of Premacor 1410 and 5.3 parts of polynorbonene (Norsorex NS, Zeon Chem. Co.) were used for preparing a PTC composition and device in the same manner as in Example 1. Physical properties were measured, and the results are shown in Table 1.

Example 15

Instead of 42.4 parts of HDPE 8380, 5.3 parts of Surlyn 8940, 3.3 parts of Kraton FG-1 901 X and 2.0 parts of Kraton D-1101 of Example 1, 42.4 parts of EM 530, 3.3 parts of EEA A-710, 2.0 parts of Surlyn 7930, 3.3 parts of Kraton FG-1901X and 2.0 parts of OZO-HA were used for preparing a PTC composition and device in the same manner as in Example 1. Physical properties were measured, and the results are shown in Table 1.

What is claimed is:

1. A conductive polymer composition having PTC properties comprising: (a) at least one crystalline thermoplastic olefin-based polymer and at least one rubber-based polymer resin containing unsaturated group selected from the group consisting of natural rubber, isoprene rubber, butadiene rubber, styrene-butadiene rubber, butyl rubber, chloroprene rubber, nitrile-based rubber, carboxylated nitrile-based rubber, sulfonated ethyl-propylene-diene rubber, butadiene (meth) acrylic acid rubber resin, polynorbonene, polypentenamer, polyoctenamer, styrene linear and branched copolymer rubber, and mixtures thereof; and (b) conductive particles dispersed in a polymer matrix formed of component (a).

2. The composition of claim 1, wherein the crystallinity of the olefin-based polymer is at least 20%.

3. The composition of claim 1, wherein the olefin-based polymer is selected from the group consisting of polyethylene, polypropylene, a copolymer of ethylene with a monomer having a polar group, a copolymer of propylene with a monomer having a polar group and mixtures thereof.

4. The composition of claim 1, wherein the amount of olefin-based polymer resin is at least 60% by weight of the entire polymer.

5. The composition of claim 1, wherein the amount of rubber-based polymer resin containing an unsaturated group is in the range of 0.1–40% by weight of the entire polymer.

6. The composition of claim 1, further comprising one or more rubber resins selected from the group consisting of silicone rubber, fluoride rubber, acrylic rubber, epichlorohydrin rubber and mixtures thereof.

7. The composition of claim 1, wherein the conductive particle is selected from the group consisting of powder of a metal including nickel, silver, gold, copper or metal alloys, metal-coated particle, carbon black and acetylene black.

8. The composition of claim 7, wherein the conductive particle is a carbon black.

9. The composition of claim 1, wherein the content of the conductive particles is in the range of 5–70% by weight of the composition.

10. A circuit protecting PTC device, in which two or more metallic thin films are attached to both surfaces of the conductive polymer composition according to any one of claims 1 to 5 and 6 to 9, thereby to connect electrodes.

11. The device of claim 10, wherein the metallic thin films attached onto the both surfaces of the conductive polymer composition as electrodes are selected from the group consisting of copper, nickel, stainless steel thin film, electro-deposited copper thin plate having a micro-level of roughness on one surface, nickel-coated electro-deposited copper thin plate by electrolysis, electro-deposited copper thin plate on which non-electrolytic nickel is coated, and electro-deposited copper thin plate on which chrome is coated.

12. A circuit comprising the PTC device according to claim 10.

* * * * *